United States Patent [19]

Vidakovits et al.

[11] 4,283,596

[45] Aug. 11, 1981

[54] CONNECTOR AND CONNECTION METHOD

[75] Inventors: Lajos J. Vidakovits, Mountain View, Calif.; Didier J. M. Watine, Maisons Laffitte, France

[73] Assignee: Raychem Pontoise S.A., Saint-Ouen l'Aumone, France

[21] Appl. No.: 36,368

[22] Filed: May 7, 1979

[30] Foreign Application Priority Data

May 9, 1978 [GB] United Kingdom ..... 18451/78

[51] Int. Cl.[3] ..... H01R 4/00

[52] U.S. Cl. ..... 174/84 R; 174/87; 174/DIG. 8

[58] Field of Search ..... 174/84 R, 94 R, DIG. 8, 174/72 R, 87

[56] References Cited

U.S. PATENT DOCUMENTS

| | | | |
|---|---|---|---|
| 3,243,211 | 3/1966 | Wetmore . | |
| 3,320,355 | 5/1967 | Booker | 174/84 R |
| 3,360,631 | 12/1967 | Hess | 174/DIG. 8 X |
| 3,622,941 | 11/1971 | Wetmore | 339/98 |
| 3,678,174 | 7/1972 | Ganzhorn | 174/84 R |
| 3,838,206 | 9/1974 | Eklund | 174/87 |
| 3,995,964 | 12/1976 | De Groef | 403/272 |
| 4,107,453 | 8/1978 | Erixon | 174/87 |

FOREIGN PATENT DOCUMENTS

| | | | |
|---|---|---|---|
| 1098304 | 1/1968 | United Kingdom | 174/DIG. 8 |
| 1232508 | 5/1971 | United Kingdom . | |
| 1270367 | 4/1972 | United Kingdom . | |
| 1428134 | 3/1976 | United Kingdom . | |

*Primary Examiner*—Roy N. Envall, Jr.
*Attorney, Agent, or Firm*—Lyon & Lyon

[57] ABSTRACT

A method of making an electrical connection between two electrical conductors includes, in addition to making the electrical connection, the steps of positioning the conductors within a heat-shrinkable sleeve whereby they are held, by an insert positioned within the sleeve, in a substantially fixed transverse relationship to each other in the sleeve, and applying heat to shrink the sleeve. Electrical connectors are also described, one of which comprises a heat-shrinkable sleeve having an insert positioned therein for holding conductors to be connected in a substantially fixed relationship to each other, and a quantity of solder positioned within the sleeve between the insert and an end of the sleeve. A further connector comprises a heat-shrinkable sleeve having an insert positioned therein, the insert comprising at least two compartments side-by-side to one another.

35 Claims, 7 Drawing Figures

CONNECTOR AND CONNECTION METHOD

The present invention relates to a method for making an electrical connection between two electrical conductors and to connectors suitable for use in such a connection.

Heat-recoverable sleeves have been widely used in the making of electrical connections, the change in dimensions of such a sleeve on heating being in some cases used only to ensure, for example, that a sleeve which is large enough to be slipped easily over a joint to be insulated is, after heating, a tight fit about the joint, and in other cases used also, or alternatively, to, for example, move or exert pressure on another substance or object. Thus, for example, if a heat-shrinkable sleeve contains a fusible material (for example solder) as disclosed in U.S. Pat. No. 3,243,211, the fusible material may be forced, on shrinking of the heat-shrinkable sleeve, into close contact with a substrate within the sleeve. Whether or not a substance such as a fusible material is present, the shrinking of a heat-shrinkable sleeve may also act to move together, or to maintain together, two electrical conductors inserted in the sleeve so that a reliable electrical connection can be made between them.

Although heat-recoverable sleeves such as those described in U.S. Pat. No. 3,243,211 have proved very satisfactory for a wide number of applications in the making of electrical connections, problems may be encountered where a connection is to be made between relatively thick single conductors. Thus, for example, the force exerted by a heat-shrinkable sleeve of an appropriate size during shrinking may not always be sufficiently great to bring thick conductors close enough together for a reliable electrical connection to be made; when thick conductors are inserted side-by-side through the same end of a sleeve they may have a tendency to spring apart, a tendency which will not necessarily be overcome by twisting the conductors together before inserting them into the sleeve.

The present invention provides a method of making an electrical connection between two electrical conductors which, in addition to making the electrical connection, includes the steps of positioning the conductors within a heat-shrinkable sleeve such that each conductor extends out of a first end of the sleeve, the conductors being held, by an insert positioned within the sleeve, in a substantially fixed transverse relationship to each other in the sleeve whereby an electrical connection can be made between the conductors, the insert being infusible at the temperature to which the components are heated to cause shrinkage of the sleeve, and applying heat to shrink the sleeve. The insert is advantageously positioned in the sleeve before the conductors are positioned in the sleeve.

The invention also provides a method of making an electrical connection between two electrical conductors which, in addition to making the electrical connection, includes the steps of inserting each conductor into a first end of a heat-shrinkable sleeve at least the first end of which is open, the sleeve having an insert therein, which insert is infusible at the temperature to which the components are heated to cause shrinkage of the sleeve and is such that it holds the conductors in a substantially fixed transverse relationship to each other whereby an electrical connection can be made within the sleeve between the electrical conductors, and applying heat to shrink the sleeve.

The present invention further provides a method of making an electrical connection between two electrical conductors which, in addition to making the electrical connection, includes the steps of inserting each conductor into a first end of a heat-shrinkable sleeve open at at least the first end, the sleeve having an insert therein, which insert is infusible at the temperature to which the components are heated to cause shrinkage of the sleeve and provides at least two compartments side-by-side to each other in the sleeve, each conductor being received in a different compartment whereby an electrical connection can be made within the sleeve between the electrical conductors, and applying heat to shrink the sleeve.

In accordance with the invention, the electrical connection between the conductors may be made by any desired method. Thus, for example, the connection may be made by one of the steps recited above, for example merely by positioning the conductors in the insert, or by some other step which may or may not be carried out substantially simultaneously with one or more of the steps recited above.

The electrical connection may, for example, be made or enhanced by solder and/or made or enhanced by direct contact of the conductors. If the insert is electrically conductive, the electrical connection may be made through the insert although unless the conductors are pretinned and are relatively closely received in the insert, it will normally be necessary, if the connection is to be made through the insert, for the connector to contain a quantity of solder, for example as a layer on the interior of the insert or in such a position that on fusing it can flow or be forced into the interior of the insert, to ensure that a reliable connection is made between each conductor and the insert. Preferably, however, an electrical connection is made between the conductors which is independent of any electrical connection of the conductors through the insert, the independent connection advantageously being made or enhanced by solder and/or made or enhanced by direct contact of the conductors.

An advantageous method of making or enhancing an electrical connection between the conductors by direct contact of the conductors comprises twisting together portions of the conductors which are within the sleeve but which are not held by the insert. The said portions are advantageously twisted together by rotating the connector about its longitudinal axis while rotational movement of the portions of the conductors extending out of the connector is substantially prevented. Where an electrical connection between the conductors is made or enhanced by solder, the heat-shrinkable sleeve may, for example, contain a quantity of solder, heat being applied to cause the heat-shrinkable sleeve to shrink and to cause the solder to fuse and to make or enhance an electrical connection between the conductors. Where the sleeve contains a quantity of solder the insert must of course be infusible at the temperature to which the connector is heated to cause the sleeve to shrink and the solder to fuse.

The invention also provides a method of making an electrical connection between two electrical conductors which method includes the steps of inserting the conductors into the first end of an electrically conductive insert comprising at least two compartments side-by-side to each other whereby an electrical connection is made between the conductors, each conductor being received in a separate compartment, inserting the assembly into a heat-shrinkable sleeve having at least one open end, and applying heat to shrink the sleeve, the insert being infusible at the temperature to which the components are heated to shrink the sleeve.

The invention also provides a heat-recoverable connector suitable for making an electrical connection between two electrical conductors, which comprises a heat-shrinkable sleeve at least a first end of which is open, an insert positioned within the sleeve, the insert being such that it can hold the conductors in a substantially fixed transverse relationship to each other whereby an electrical connection can be made, within the sleeve, between the conductors, and a quantity of solder positioned within the sleeve between the insert and an end of the sleeve, the insert being infusable at the temperature to which in use the connector is heated to cause the sleeve to shrink and the solder to fuse.

The insert used in the method and article of the invention preferably provides at least two compartments in the sleeve, the compartments being side-by-side to one another; the walls of the compartments may, if desired, be laterally (transversely) spaced from one another, and the ends of the compartments need not necessarily be conterminous; all that is required is that at least one cross-section through the insert intersects both compartments. In use, each of at least two of the compartments receives a respective electrical conductor. The insert may, advantageously over part only of the length of the sleeve, merely divide the space within the sleeve into two or more compartments. Preferably, however, the insert itself comprises at least two compartments, that is, none of the compartments has a wall provided by a portion of the sleeve.

Where the insert provides a plurality of compartments, at least one of the conductors may, in the method of the invention, be engaged by the interior wall(s) of the compartment in which it is received. This, however, is not essential and some movement of the conductors relative to the insert (for example lateral movement in the compartments) may occur provided that the conductors are maintained in a substantially fixed transverse spatial relationship to each other so that an electrical connection can be made between them. Preferably, however, little or substantially no transverse movement of the conductors relative to the insert takes place. Advantageously, the insert also maintains the conductors in a substantially fixed longitudinal relationship to each other.

The invention further provides a heat-recoverable connector suitable for making an electrical connection between two electrical conductors, which connector comprises a heat-shrinkable sleeve at least a first end of which is open, and an insert positioned within the sleeve, the insert being infusible at the temperature to which in use the connector is heated to shrink the sleeve and comprising at least two compartments side-by-side to each other.

When the insert used in accordance with the invention comprises a plurality of compartments each compartment is preferably defined by a substantially tubular wall which is preferably joined to the other or another substantially tubular wall by a bridging member. The insert may, for example, be formed from a sheet of material opposite edges of which have been rolled towards each other to form the walls of the compartments, or may, for example, be formed from a generally cylindrical member, substantially diametrically opposed portions of which member have been deformed radially inwardly whereby the compartments are formed, the inwardly deformed portions forming a pair of bridging members between the substantially tubular walls of the compartments; the bridging members may be spaced apart from each other so that the compartments are in communication with each other. The connector preferably also comprises a quantity of solder positioned within the sleeve between the insert and an end of the sleeve.

When the heat-shrinkable sleeve used in accordance with the invention has a quantity of solder therein this may, if desired or required, be associated with a quantity of flux. The solder may be in any desired form, but is advantageously in the form of a ring. The solder is preferably positioned between the insert and the first end of the sleeve.

The heat-shrinkable sleeve used in accordance with the invention is a sleeve at least part of which will shrink on the application of heat and may comprise any material, advantageously an electrically insulating material, which may be converted to or maintained in a heat-shrinkable form. Examples of suitable materials are given, for example, in U.S. Pat. Nos. 3,086,242, 3,243,211 and 3,297,819, the disclosures of which are incorporated herein by reference. Crosslinked polymeric materials are particularly suitable. The sleeve may be open at one or both ends and may be provided at or in the vicinity of the or each open end with a quantity of fusible material or other sealing material to enhance the environmental seal at the end(s) of the heat-shrinkable sleeve. Thus, the sleeve can force fused fusible material into close contact with a conductor received in the open end of the sleeve to provide a reliable seal. Alternatively, the sleeve and fused fusible material could cooperate to produce a seal even at an open end that does not receive a conductor.

This insert may comprise any suitable material, but is advantageously electrically conductive, and preferably comprises a metal. The insert is advantageously substantially dimensionally stable (apart from normal thermal expansion) at the temperature to which the components are heated to cause the sleeve to shrink and the solder, if present, to fuse. The insert is preferably spaced from at least one end of the sleeve.

In accordance with the invention, a reliable electrical connection may be made between two conductors, for example conductors in telecommunication cables, even when these are relatively thick. Thus, the insert can maintain the conductors in position relative to each other so that an electrical connection can be made between them, for example by twisting and/or soldering, without the need to rely on the recovery forces of the sleeve to bring or maintain the conductors in the desired positions. Furthermore, when the insert is appropriately constructed, an electrical connection may be made between conductors inserted into the connector merely by twisting the connector about its longitudinal axis while movement of the portions of conductors extending out of the connector is substantially prevented.

Two embodiments of the invention will now be described, by way of example only, with reference to the accompanying drawings, in which.

Figure 1:
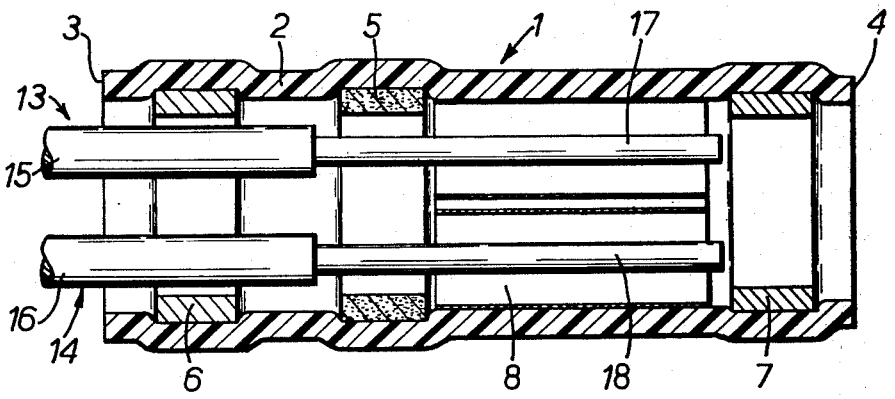
FIG. 1 is a cross-section through a connector according to the invention having two conductors inserted therein.

Referring now to the drawings, FIG. 1 shows a connector indicated generally by the reference numeral 1 comprising a heat-shrinkable sleeve 2 of electrically insulating material, the sleeve having two open ends, 3 and 4 respectively. A ring 5 of solder is positioned within the sleeve 2 and rings, 6 and 7 respectively, of fusible polymeric material are positioned between the solder ring 5 and each of the open ends 3 and 4. The sleeve 2 also has positioned within it an insert indicated generally by the reference numeral 8, the insert being positioned between the solder ring 5 and the fusible insert 7.

Figure 3:
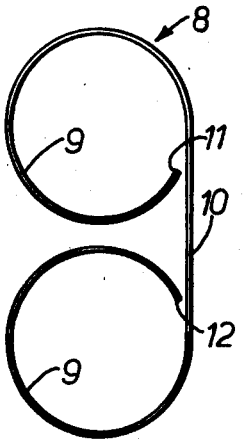
FIG. 3 is an end view of the insert of the connector of FIG. 1.
Figure 4:
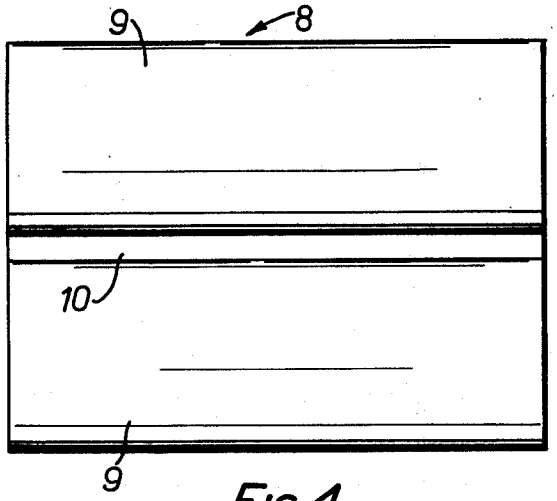
FIG. 4 is a side view of the insert of the connector of FIG. 1.

As can be most clearly seen from FIGS. 3 and 4, the insert comprises a pair of compartments 9 defined by generally tubular walls joined by a bridging member 10. The insert may be formed from a single sheet of metal, opposite edges 11 and 12 of the sheet being rolled inwardly to provide the tubular walls.

The connector of FIGS. 1 to 4 may be used to make an electrical connection between two wires indicated generally by the reference numerals 13 and 14. A portion of the insulation 15, 16 is stripped from each of the wires 13 and 14 to give stripped end portions 17 and 18, and the stripped end portions 17 and 18 are introduced into the connector through the open end 3 of the heat-shrinkable sleeve 2. Each end portion is inserted in a compartment 9 of the insert 8, the insert thereby maintaining the end portions in substantially fixed spatial relationship to each other. Some movement of the end portions 17 and 18 in the compartments may be possible, but each end portion is maintained within the confines of the respective compartment. It will be noted that a part of each stripped end portion 17, 18 is positioned within solder rings.

Figure 2:
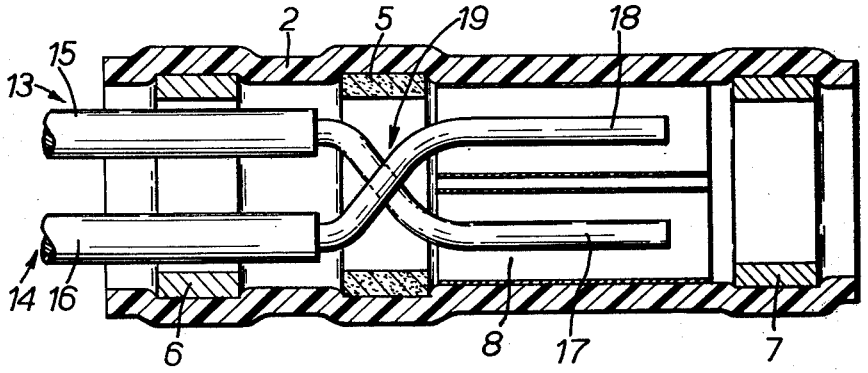
FIG. 2 shows the connector of FIG. 1 after twisting of the conductors.

The insert 8 makes it possible to make a reliable electrical connection between the stripped conductors. Thus, after insertion of the end portions 17 and 18 into the insert 9 to give the arrangement shown in FIG. 1, the connector may be rotated about its longitudinal axis while movement of the insulated portions of wires 13 and 14 is substantially prevented. The stripped portions of conductors adjacent to the insert 8 are thereby twisted into contact with each other at 19 (see FIG. 2). Although for simplicity only one twist is shown in FIG. 2, more than one twist may of course be made. The connector may then be heated to cause the heat-shrinkable sleeve 2 to shrink and the solder ring 5 and fusible rings 6 and 7 to fuse. The fused solder enhances the electrical connection made by twisting of the conductors, while the sleeve 2 and fusible insert 6 are forced into close contact with the wire insulation to form an environmental seal. The end 4 of the sleeve 2 is completely closed by the shrinking of the sleeve and the fusing of the fusible ring 7, so that the connection between the conductors is completely sealed from the environment.

Although the sleeve 2 in FIGS. 1 and 2 is shown as having two open ends, the end 4 could if desired be closed. Moreover, where a satisfactory electrical connection between the bared portions of the conductors can be made merely by twisting, the solder may be omitted. Alternatively, if solder is present, the twisting step may in some cases be omitted. The fusible rings 6 and 7 may also be omitted if circumstances are such that a satisfactory environmental seal may be made without them.

Figure 5:
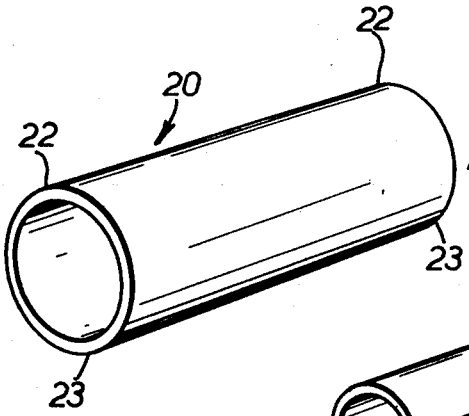
FIG. 5 is a perspective view of a member which may be used for making a second insert according to the invention.
Figure 6:
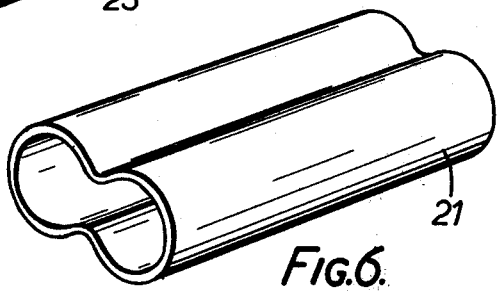
FIG. 6 is a perspective view of a insert made from the member shown in FIG. 5.
Figure 7:
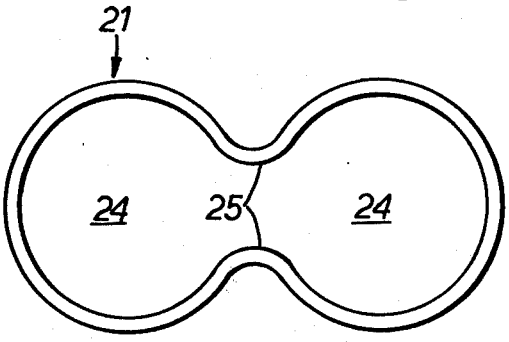
FIG. 7 is a cross-section through the insert of FIG. 6.

FIG. 5 shows a cylindrical member indicated generally by the reference numeral 20 which may be used for forming a second insert, indicated generally in FIG. 6 and 7 by the reference numeral 21, which may be used in accordance with the invention. The insert 21 is formed by deforming substantially diametrically opposite portions 22, 23 of the cylindrical member 20 radially inwardly thereby forming two compartments 24 each of which is defined by a substantially tubular wall and is joined by a pair of bridging members 25 to the other compartments, the inwardly deformed portions 22 and 23 providing the bridging members. The insert 21 could, for example, be used in place of the insert 8 of FIGS. 1 to 4.

It is to be understood that, in the method of the present invention, the resulting electrical connection between the conductors is effected without the necessity for dimensional change of the insert on shrinkage of the sleeve, although the possibility that incidental dimensional change takes place is not excluded. The article of the invention is accordingly so constructed as to enable this to be achieved.

References to the insert being substantially dimensionally stable are to the fact that the insert is not itself made of a material that is heat-recoverable at the shrinkage temperature or the fusing temperature of the solder, if present.

We claim:

1. In a method for electrically connecting together two elongate electrical conductors, the improvement comprising the steps of selecting a heat-recoverable sleeve having an insert disposed therein to locate the conductors, the insert being infusible and substantially dimensionally stable at the heat-recovery temperature of the sleeve and having two separate compartments, introducing the conductors into the insert in the sleeve so that the conductors are enclosed within respective ones of the compartments and are laterally spaced from each other, and applying heat to recover the sleeve.

2. A method according to claim 1, comprising the step of providing solder as a ring retained by and extending around an internal wall of the sleeve adjacent an end of the insert.

3. A method as claimed in claim 1, wherein the step of selecting a heat-recoverable sleeve comprises positioning the insert in the sleeve.

4. A method as claimed in claim 1 including the step of making an independent electrical connector between the conductors independent of any electrical connection of the conductors through the insert.

5. A method as claimed in claim 4, wherein the independent electrical connection comprises a solder connection.

6. A method as claimed in claim 4 or claim 5, wherein the independent electrical connection comprises direct contact of the conductors.

7. A method as claimed in claim 1 comprising the step of bringing into direct contact with each other a portion of each conductor which is within the sleeve but is not held by the insert.

8. A method as claimed in claim 7, wherein the conductors are brought into direct contact with each other by twisting together a portion of each conductor which is within the sleeve but is not held by the insert.

9. A method as claimed in claim 8, wherein the said portions are twisted together by rotating the connector about its longitudinal axis while movement of the portions of the conductors extending out of the connector is substantially prevented.

10. A method as claimed in claim 1, comprising the step of making a solder electrical connection between the conductors.

11. A method as claimed in claim 1, wherein the heat-shrinkable sleeve contains a quantity of solder and the insert is infusible at the temperature to which the sleeve and the solder are heated to cause the heat-shrinkable sleeve to shrink and the solder to fuse, and the step of applying heat comprises causing the heat-shrinkable sleeve to shrink and causing the solder to fuse for making an electrical connection comprising a solder connection between the conductors.

12. A method as claimed in claim 1, wherein a quantity of fusible polymeric material is positioned between the insert and at least one open end of the heat-shrinkable sleeve, and wherein the step of applying heat comprises fusing the fusible polymeric material.

13. A method as claimed in claim 1, wherein the insert provides at least two compartments side-by-side to each other in the sleeve and each conductor is positioned in a separate compartment.

14. A method as claimed in claim 1, wherein the insert comprises a plurality of compartments side-by-side to one another.

15. A method as claimed in claim 1 wherein each compartment is defined by a substantially tubular wall.

16. A method as claimed in claim 15, wherein each substantially tubular wall is joined to another substantially tubular wall by a bridging member.

17. A method as claimed in claim 1, wherein the insert is formed from a single sheet of material opposite edges of which have been rolled towards each other to form the compartments.

18. A method as claimed in claim 1, wherein the insert is formed from a generally cylindrical member substantially diametrically opposed portions of which member have been deformed radially inwardly whereby two compartments are formed, the inwardly deformed portions forming a pair of bridging members between the substantially tubular walls of the compartments.

19. A method as claimed in claim 1, wherein each compartment has an interior wall and each conductor is engaged by the interior wall of its respective compartment.

20. A method for connecting together two elongate electrical conductors, the method comprising the steps of disposing within a heat-recoverable sleeve an insert arranged to locate said conductors, the insert being infusible and substantially dimensionally stable at the recovery temperature of the sleeve and having two separate compartments, positioning the conductors to have first ends thereof projecting from one end of the sleeve, making electrical connection between the conductors by relatively rotating the first and second conductor ends, providing a ring of solder retained by an inner wall of the sleeve between the insert and said one end of the sleeve, providing a ring of polymeric material adjacent said one end of the sleeve, and applying heat to recover the sleeve, melt the solder and fuse the polymeric material.

21. A method according to claim 1 or 20, in which the compartments of the insert are arranged to maintain the conductors in a substantially fixed relationship parallel to each other.

22. A heat-recoverable connector arrranged to connect together two elongate electrical conductors, the connector comprising a heat-recoverable sleeve, an insert retained within the sleeve and arranged to locate the conductors, the insert being infusible and substantially dimensionally stable at the recovery temperature of the sleeve and having two separate compartments, the compartments being arranged to enclose respective ones of the conductors and locate the conductors laterally spaced from each other, whereby electrical connection can be made between the conductors.

23. A heat-recoverable connector according to claim 22, wherein the solder is provided as a ring retained by and extending around an internal wall of the sleeve.

24. A heat-recoverable connector according to claim 23, wherein the polymeric material is provided as a ring retained by and extending around an internal wall of the sleeve.

25. A connector as claimed in claim 22, wherein each compartment is defined by a substantially tubular wall.

26. A connector as claimed in claim 25, wherein each substantially tubular wall is joined to the another substantially tubular wall by a bridging member.

27. A connector as claimed in claim 22 wherein the insert is formed from a sheet of material opposite edges of which have been rolled towards each other to form the walls of the compartments.

28. A connector as claimed in claim 22, wherein the insert is formed from a generally cylindrical member, substantially diametrically opposed portions of which member have been deformed radially inwardly whereby two compartments are formed, the inwardly deformed portions forming bridging members between the compartments.

29. A connector as claimed in claim 28, wherein the bridging members are spaced apart from each other so that the compartments are in communication with each other.

30. A connector as claimed in claim 22, which also comprises a quantity of solder positioned within the sleeve between the insert and an end of the sleeve and wherein the insert is infusible at the temperature to which in use the connector is heated to cause the sleeve to shrink and the solder to fuse.

31. A connector as claimed in claim 30 or claim 22, which also comprises a quantity of fusible polymeric material positioned between the insert and the or each open end of the sleeve.

32. A heat-recoverable connector arranged to connect together two elongate electrical conductors, the connector comprising a heat-recoverable sleeve having at least one open end, a ring of polymeric material adjacent and retained by the open sleeve end, a ring of solder retained around an inner wall of the sleeve axially inwardly of the ring of polymeric material, and an insert disposed adjacent the ring of solder, the insert having two separate compartments arranged to enclose respective ones of the conductors laterally spaced from each other, whereby electrical connection can be made within the sleeve between the conductors, the insert being infusible, and the polymeric material and the solder being fusible when the sleeve is recovered.

33. A heat-recoverable connector according to claim 22 or 32, in which the compartments of the insert are arranged to maintain the conductors in a substantially fixed relationship parallel to each other.

34. In a method for electrically connecting two elongate electrical connectors, the improvement comprising the steps of (a) selecting a heat-recoverable connector comprising a heat-recoverable sleeve, an insert retained within the sleeve and arranged to locate the conductors, the insert being infusible and substantially stable at the recovery temperature of the sleeve and having two separate compartments, the compartments being arranged to enclose respective ones of the conductors completely and locate the conductors laterally spaced from each other; (b) introducing the conductors into the insert in the sleeve so that the conductors are enclosed within respective ones of the compartments and are laterally spaced from each other; and (c) applying heat to recover the sleeve.

35. An assembly comprising a heat-recovered sleeve having an insert disposed therein, the insert being infusible and substantially dimensionaly stable at the heat-recovery temperature of the sleeve and having two separate compartments and two conductors within the insert and disposed so that the conductors are completely enclosed within respective ones of the compartments and are laterally spaced from each other, the conductors being electrically connected to each other.

* * * * *